US005987645A

United States Patent [19]

Teaster

[11] Patent Number: 5,987,645

[45] Date of Patent: Nov. 23, 1999

[54] SANITARY HAND SHIELDS

[76] Inventor: Sherrill Dean Teaster, 57533 Apple La., New Hudson, Mich. 48165

[21] Appl. No.: 09/183,681

[22] Filed: Oct. 30, 1998

Related U.S. Application Data

[60] Provisional application No. 60/063,783, Oct. 31, 1997.

[51] Int. Cl.[6] ..... A41D 19/00

[52] U.S. Cl. ..... 2/159; 2/16; 2/161.6; 15/227; 150/154

[58] Field of Search ..... 2/16, 158, 159, 2/161.7, 161.6, 167, 169; D2/610, 611, 617, 619, 622; 150/154; 15/227; 602/21, 22, 61, 62; 132/73, 285

[56] References Cited

U.S. PATENT DOCUMENTS

| | | | |
|---|---|---|---|
| 628,354 | 7/1899 | Read . | |
| 722,863 | 3/1903 | Lodge | 15/227 |
| 1,478,914 | 12/1923 | Ritzenthaler | 15/227 |
| 1,731,340 | 10/1929 | Lambert | 2/167 |
| 1,910,094 | 5/1933 | Crane et al. . | |
| 2,075,850 | 4/1937 | Johnson | 401/701 |
| 2,261,064 | 10/1941 | Katz . | |
| 2,581,340 | 1/1952 | Allen . | |
| 2,695,999 | 12/1954 | Arnold . | |
| 2,782,912 | 2/1957 | Humphrey . | |
| 2,817,851 | 12/1957 | Barnwell . | |
| 2,884,162 | 4/1959 | Crebbs . | |
| 2,935,241 | 5/1960 | Brady . | |
| 2,999,523 | 9/1961 | Amdur . | |
| 3,109,474 | 11/1963 | Levi . | |
| 3,181,773 | 5/1965 | Jelling et al. . | |
| 3,183,543 | 5/1965 | Worcester | 15/104.94 |
| 3,186,625 | 6/1965 | Mead et al. . | |
| 3,199,121 | 8/1965 | Greto . | |
| 3,343,578 | 9/1967 | Rubin . | |
| 3,685,720 | 8/1972 | Brady . | |
| 3,722,470 | 3/1973 | Farrell . | |
| 3,749,237 | 7/1973 | Dorton . | |
| 4,017,907 | 4/1977 | Margolis . | |
| 4,071,921 | 2/1978 | Jury . | |
| 4,353,139 | 10/1982 | Wainwright et al. . | |
| 4,510,640 | 4/1985 | Omori | 15/104 |
| 4,605,124 | 8/1986 | Sandel et al. . | |
| 4,677,697 | 7/1987 | Hayes | 2/159 |

(List continued on next page.)

FOREIGN PATENT DOCUMENTS

| | | |
|---|---|---|
| 2542980 | 3/1983 | France . |
| 730258 | 1/1943 | Germany . |

*Primary Examiner*—Diana Oleksa
*Assistant Examiner*—Kate M. Moran
*Attorney, Agent, or Firm*—Susan M. Cornwall; Lynn E. Cargill

[57] ABSTRACT

A two-sided pocketed hand shield (10, 12, or 16) for protecting a hand from germs includes a sheet (18) of flexible material and a piece (28 or 48) of flexible material. The piece (28 or 48) of flexible material is shorter than the sheet (18) and attached to the front surface of the sheet (18) in a manner to form a pocket adapted to fit a hand and in a manner that (a) leaves an opening (60, 64, or 72) for the insertion of a hand and (b) allows the sheet (18) to extend beyond the opening (60, 64, or 72). The opening (60, 64, or 72) has two ends and is preferably angled from one end to the other end. The sheet (18) may be rectangular and the piece (28 or 48) may be mitten-shaped or trapezoidal, and either may be formed of absorbent material or plastic. The piece (28 or 48) is preferably attached to the sheet in a way which renders the pocket in the shape of a mitten. Another embodiment is an array (80) of pocketed sanitary hand shields (81). The array (80) of hand shields (81) includes a continuous sheet (82) of a flexible material having evenly-spaced weakened connections (85) dividing the sheet (82) into sections (86) and a piece (83) of a flexible material attached to the front surface of each section (86). Each piece (83) is attached to the continuous sheet (82) in a manner that forms a pocket adapted to fit a hand.

12 Claims, 2 Drawing Sheets

U.S. PATENT DOCUMENTS

| | | | |
|---|---|---|---|
| 4,722,296 | 2/1988 | Bowskill et al. . | |
| 4,856,140 | 8/1989 | Visco et al. . | |
| 4,871,046 | 10/1989 | Turner . | |
| 4,921,028 | 5/1990 | Schwartz . | |
| 4,974,288 | 12/1990 | Reasner . | |
| 5,007,558 | 4/1991 | Allen et al. . | |
| 5,010,617 | 4/1991 | Nelson | 15/227 |
| 5,127,127 | 7/1992 | Jarosinksi | 15/227 |
| 5,355,292 | 10/1994 | Hoftman et al. . | |
| 5,408,400 | 4/1995 | Gordon . | |
| 5,473,789 | 12/1995 | Oster | 15/227 |
| 5,649,336 | 7/1997 | Finch et al. | 15/227 |
| 5,799,331 | 9/1998 | Stewart | 2/159 |

SANITARY HAND SHIELDS

This application claims the benefit of U.S. Provisional Application Ser. No. 60/063,783 filing date, Oct. 31, 1997.

BACKGROUND OF THE INVENTION

1. Field of the Invention

The present invention relates generally to sanitary hand shields and, more particularly, to disposable hand shields useful for protecting one's hand from germs.

2. Description of the Related Art

In today's society, people have become more aware and educated about the presence of germs. Germs that are present on certain surfaces, such as door knobs, are very susceptible to spreading from one person to another. Areas such as bathrooms, hospital rooms, doctors' exam rooms, and kitchens typically have an abundance of unwanted germs present. Washing one's hands is a good defense against germs, but does not protect the hand from germs when subsequently opening a door, etc. It is, therefore, desirable to have available a device for protecting one's hand or hands from germs when contacting surfaces such as doors and door knobs.

The present invention, therefore, seeks to provide a device for protecting one's hand from germs.

Another advantage being sought by the present invention is a disposable device for protecting one's hand from germs which is easy to make, easy to use, and is comfortable to wear.

SUMMARY OF THE INVENTION

In accordance with the present invention, one embodiment is a two-sided pocketed sanitary hand shield (10, 12, or 16) for protecting a hand from germs. The hand shield includes a sheet (18) of flexible material forming one side of the hand shield and a piece (28 or 48) of flexible material forming the second side of the hand shield. The piece (28 or 48) of flexible material is shorter than the sheet (18) and attached to the front surface of the sheet (18) in a manner to form a pocket adapted to fit a hand and in a manner that (a) leaves an opening (60, 64, or 72) for the insertion of a hand and (b) allows the sheet (18) to extend beyond the opening. The opening (60, 64, or 72) has two ends and is angled from one end to the other end.

The sheet (18) may be rectangular and the piece (28 or 48) may be mitten-shaped or trapezoidal, and either may be formed of absorbent material or plastic. The piece (28 or 48) is preferably attached to the sheet (18) in a way which renders the pocket in the shape of a mitten. The hand shield (10, 12, or 16) may further have a fragrance included in a part of the hand shield.

Another embodiment of the present invention is an array (80) of pocketed sanitary hand shields (81) wherein each hand shield (81) is for receiving a hand and for protecting the hand from germs. The array (80) of hand shields (81) includes a continuous sheet (82) of a flexible material having evenly-spaced weakened connections (85) dividing the sheet (82) into sections (86) and a piece (83) of a flexible material attached to the front surface of each section (86). Each piece (83) is attached to the continuous sheet (82) in a manner that forms a pocket adapted to fit a hand and leaves an opening (90) having two ends (92, 94), the opening (90) for the insertion of the hand. Each piece (83) is shorter than each section (86) and is positioned so that the opening (90) is spaced away from the edge (87) of the section.

The continuous sheet (82) and the pieces (83) may be formed of absorbent material or plastic. The sections (86) may be rectangular and the pieces (83) may be mitten-shaped, rectangular, or trapezoidal. The pieces (83) are preferably attached to the sections (86) in a way which renders the pockets in the shape of mittens. It is preferred that the opening (90) of each hand shield be angled from one end (92) of the opening to the other end (94) of the opening. The array (80) of hand shields may further have a fragrance, an antibacterial compound, and/or a disinfectant included in a part thereof.

Other advantages of the present invention will be readily appreciated as the same becomes better understood after reading the subsequent description taken in conjunction with the appendant drawings.

DESCRIPTION OF THE PREFERRED EMBODIMENT(S)

Figure 1:
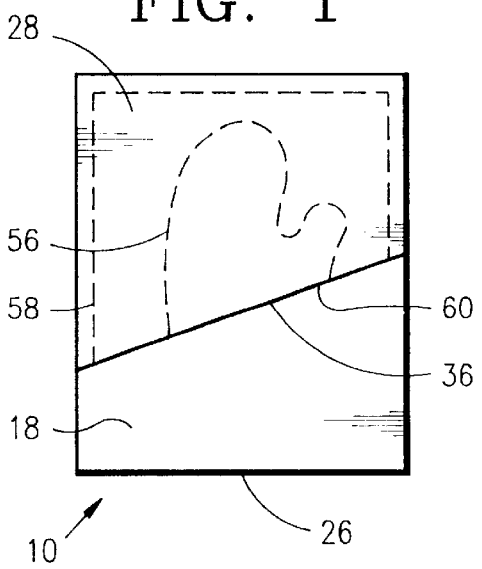
FIGS. 1–3 show elevational views of three hand shields according to the present invention.
Figure 2:
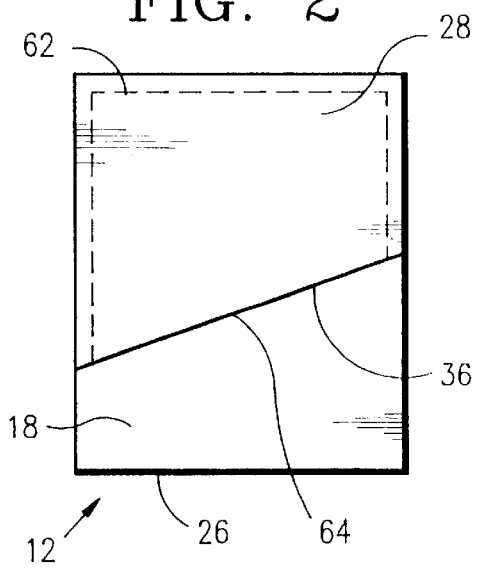
Figure 3:
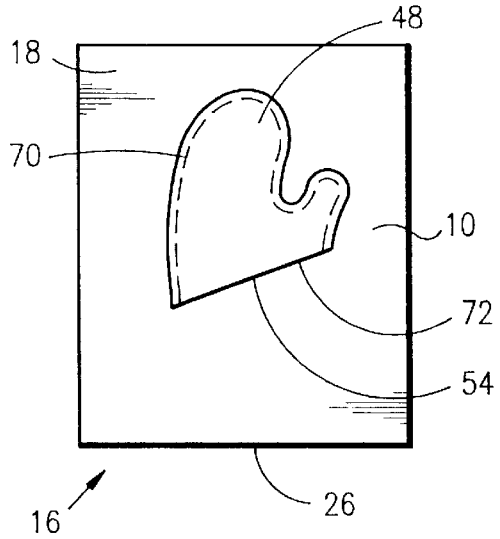

Referring to the Drawings, FIGS. 1–3 depict three variations of two-sided pocketed hand shields according to the present invention, namely, hand shields 10, 12, and 16, respectively. Hand shields 10, 12, and 16 are formed from the components shown in FIGS. 4–6.

Figure 4:
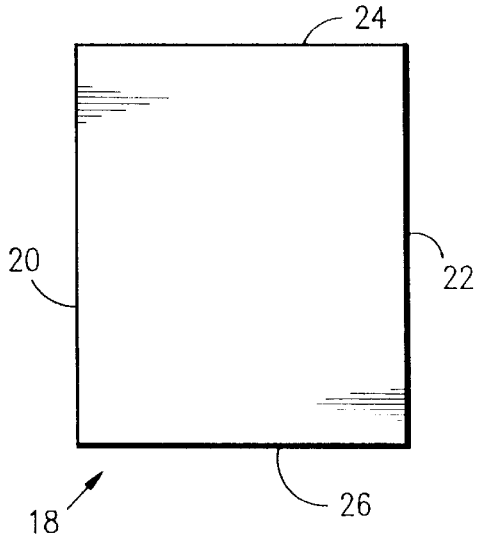
FIGS. 4–6 show elevational views of the components which form the three hand shields shown in FIGS. 1–3.

FIG. 4 shows sheet 18 of flexible material having side edges 20 and 22, top edge 24, and bottom edge 26. Although sheet 18 is shown to be rectangular, various other shapes are possible.

Figure 5:
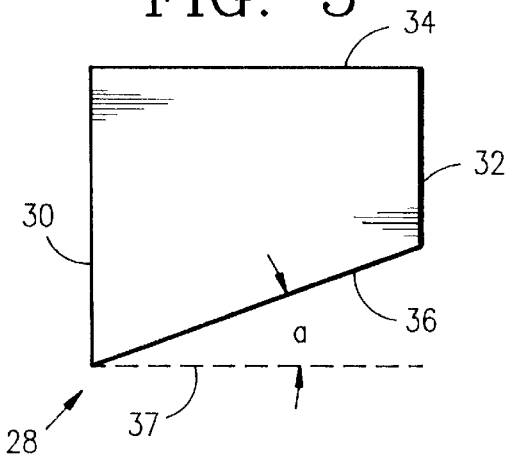
Figure 6:
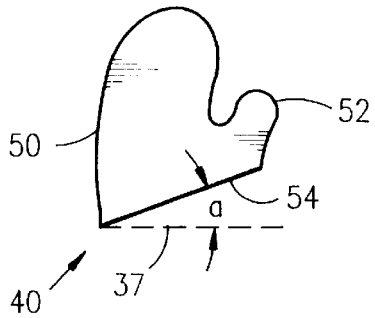

FIG. 5 shows trapezoidal piece of flexible material 28 having side edges 30 and 32, top edge 34, and bottom edge 36. Side edges 30 and 32 are generally parallel with each other and perpendicular to top edge 34, while bottom edge 36 runs at an angle from side edge 30 to side edge 32 and is, therefore, not parallel with top edge 34. Dashed line 37 represents a line perpendicular to side edges 30 and 32 and is shown to help describe angle "a" of bottom edge 36. Preferably, angle "a" of bottom edge 36 relative to line 37 is at least about a 10° angle, more preferably, at least about a 15° angle, and is preferably at most about a 40° angle. FIG. 6 shows mitten-shaped piece 48 of flexible material having side edges 50 and 52 and angular bottom edge 54. Angle "a" of bottom edge 54 has the same preferred dimensions as angle "a" shown in FIG. 5.

The width of piece 28 is essentially the same as the width of sheet 18. Pieces 28 and 48 are each shorter in length than sheet 18. Preferably, pieces 28 and 48 are at least about 10% shorter and, more preferably, at least about 25% shorter than sheet 18.

Now the hand shields of FIGS. 1–3 will be discussed with respect to the components of FIGS. 4–6 from which they are formed. All of the components of FIGS. 4–6 are sized so that, when used for forming the hand shields, the hand shields are sized to fit a hand. Hand shield 10 of FIG. 1 is formed from sheet 18 of FIG. 4 which forms one side of hand shield 10 and piece 28 of FIG. 5 which forms the other side of hand shield 10.

To form hand shield 10, piece 28 is placed on the front of sheet 18 so that the top and side edges of both are aligned with each other. Piece 28 and sheet 18 are attached together along dashed line 56 in the shape of a mitten and dashed line 58 along most of the perimeter of piece 28. Alternatively, piece 28 may be attached to sheet 18 in the entire area between dashed lines 56 and 58 or only at dashed line 56.

Note that piece 28 is not adhered to sheet 18 along bottom edge 36, leaving opening 60 between piece 28 and sheet 18 and forming a pocket for a hand. Opening 60 is closer to bottom edge 26 than any other edge on sheet 18. As mentioned, sheet 18 is longer than piece 28, thus, sheet 18 extends beyond opening 60. Due to the shape of piece 28, opening 60 is angled. Both the extra material of sheet 18 and the angle of opening 60 make it easier for one to insert one's hand inside the pocket.

To form hand shield 12 of FIG. 2, piece 28 is placed on the front of sheet 18 so that the top and side edges of both are aligned with each other. Piece 28 and sheet 18 are attached together along dashed line 62 along most of the perimeter of piece 28.

Piece 28 is not adhered to sheet 18 along bottom edge 36, leaving opening 64 between piece 28 and sheet 18 and forming a pocket for a hand. Opening 64 is closer to bottom edge 26 than any other edge on sheet 18. Similar to hand shield 10, hand shield 12 has extra material of sheet 18 which extends beyond opening 64 and an angled opening, opening 64, which make it easier for one to insert one's hand inside the pocket.

To form hand shield 16 of FIG. 3, piece 48 is placed on the front of sheet 18 so that the entire piece 48 contacts sheet 18. Piece 48 and sheet 18 are attached together along dashed line 70 which runs along the perimeter of piece 48 except at bottom edge 54, which leaves opening 72 between piece 48 and sheet 18 and forms a pocket for a hand. opening 72 is closer to bottom edge 26 than any other edge on sheet 18. Both the extra material of sheet 18 which extends beyond opening 72 and the angle of opening 72 make it easier for one to insert one's hand inside the pocket.

Sheet 18 and pieces 28 and 48 may be formed from any suitable flexible material, e.g., plastic or absorbent material, such as cellulosic material like paper toweling. Preferably, at least one side of the hand shield is formed of absorbent cellulosic material so that the hand shield is breathable and comfortable to wear. More preferably, the palm side of the hand shield, such as sheet 18, is formed of absorbent cellulosic material. For disposal purposes, it is most preferred to construct both sides of the hand shield from absorbent cellulosic material as it is more biodegradable than plastic.

Figure 7:
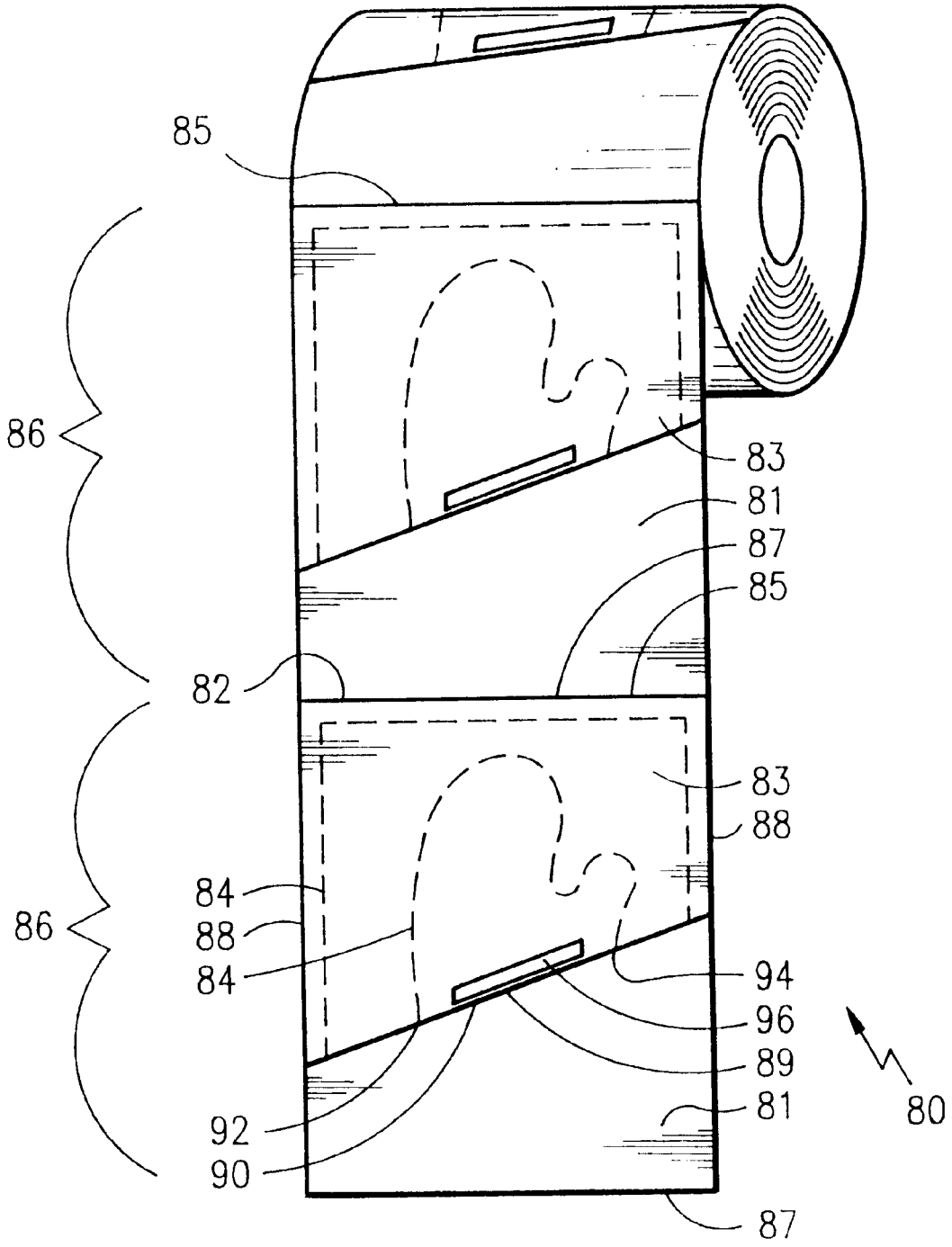
FIG. 7 shows a perspective view of a roll of hand shields according to the present invention.

FIG. 7 illustrates an embodiment of the present invention in which the hand shields of FIGS. 1–3 may be made on a continuous sheet of material and ready for use in a roll-type dispenser.

FIG. 7 shows roll 80 of hand shields 81 formed from continuous sheet 82 and trapezoidal pieces 83 attached to the front surface of continuous sheet 82 along dashed lines 84. Continuous sheet 82 has evenly-spaced weakened connections 85 dividing continuous sheet 82 into sections 86 having bottom edges 87. Weakened connections 85 may be perforations or thinned areas or another type of physical property which enables one to separate continuous sheet 82 into sections 86 by ripping, etc.

Hand shields 81 are similar to hand shields 10 shown in FIG. 1. Alternatively, hand shields 81 may be configured like those shown in FIGS. 2 or 3 or another design imaginable. Each hand shield 81 has piece 83 of material having two side edges 88 and bottom edge 89. Bottom edge 89 is shown to be angled relative to edge 87 but may alternatively, but not preferably, be parallel with edge 87. Pieces 83 are attached to continuous sheet 82 in a manner that forms a mitten-shaped pocket adapted to fit a hand and leaves opening 90 between two side edges 88 for the insertion of a hand. Opening 90 is closer to edge 87 than any other edge on section 86. Opening 90 has ends 92 and 94 and is angled from its ends relative to bottom edge 87 of section 86. Each piece 83 is shorter than each section 86 so that each opening 90 is spaced away from its corresponding bottom edge 87 of section 86.

Indicia indicating the hand shield's brand name may be placed on the hand shield at locations such as locations 96.

Continuous sheet 82 and pieces 83 may be formed from any suitable flexible material, e.g., plastic or absorbent material, such as cellulosic material like paper toweling. Preferably, at least one side of the hand shield is formed of absorbent cellulosic material so that the hand shield is breathable and comfortable to wear. More preferably, the palm side of the hand shield, such as sheet 82, is formed of absorbent cellulosic material. For disposal purposes, it is most preferred to construct both sides of the hand shield from absorbent cellulosic material as it is more biodegradable than plastic.

To make the hand shields of the present invention, the pieces may be attached to the sheets by means of gluing, pressure sealing, heat sealing, stitching, or other commonly-known techniques. The hand shields of the present invention may optionally contain a fragrance, an antibacterial compound, a disinfectant, or combinations thereof in any part of the hand shields, such as the sheet(s) of material or the pieces of material or both.

The hand shields of the present invention shown in FIGS. 1–3 or similar thereto may be placed in any suitable dispenser, e.g., they may be folded and placed in a pop-up dispenser similar to facial tissues. Roll 80 may be placed in a roll-type dispenser. The hand shields of the present invention are preferably placed in a suitable location such as in a public bathroom near the stall doors so that they may be dispensed and placed on one's hand to allow opening a door, etc., without contact with the germs on the door knob, etc. After use, the hand shields of this invention are typically discarded.

The industrial applicability of the present invention includes sanitary devices useful for minimizing hand contact with germs. The sanitary devices may be used anywhere, such as in the home, at work, or in public places.

I claim:

1. A two-sided pocketed sanitary hand shield for protecting a hand from germs, comprising:

a rectangular sheet of flexible material having a top edge, a bottom edge and two side edges, the rectangular sheet forming one side of the hand shield; and a trapezoidal piece of flexible material having a top edge, a bottom edge and two parallel side edges which are perpendicular to the top edge and not perpendicular to the bottom edge, the trapezoidal piece being sized to fit over a hand and forming the second side of the hand shield and being attached to the front surface of the sheet in a manner such that the top edges and the side edges of the rectangular sheet and the trapezoidal piece are aligned and form a pocket adapted to fit a hand, the piece being shorter than the sheet and being attached to the sheet along the top edge and the sides edges of the trapezoidal piece and the rectangular sheet to leave an opening near yet spaced away from the bottom edge of the rectangular sheet, the opening having two ends, the opening for the insertion of a hand, the opening being angled from one end to the other end relative to the bottom edge of the sheet.

2. The hand shield according to claim 1, wherein the sheet and the piece are formed of a material individually selected from the group consisting of absorbent cellulosic material and plastic.

3. The hand shield according to claim 1, wherein the trapezoidal piece is also attached to the rectangular sheet in a way which renders the pocket in the shape of a mitten having one section for the fingers of the hand and another section for the thumb of the hand.

4. The hand shield according to claim 1, further comprising a component selected from the group consisting of fragrances, antibacterial compounds, disinfectants, and combinations thereof included in a part of the hand shield, the part selected from the group consisting of the sheet, the piece, and a combination thereof.

5. The hand shield of claim 1, wherein the opening at the end of the opening closest to the bottom edge of the rectangular sheet is at least about a 10° angle and at most about a 40° angle relative to the bottom edge of the rectangular sheet.

6. A two-sided pocketed sanitary hand shield for protecting a hand from germs, comprising:

a rectangular sheet of flexible material having a bottom edge and forming one side of the hand shield; and a mitten-shaped piece of flexible material having one section for the fingers of the hand and another section for the thumb of the hand, the mitten-shaped piece having a top, a bottom edge, and two side edges, one side edge being on the finger side and the other side edge being on the thumb side, the bottom edge of the mitten-shaped piece being angled such the mitten-shaped piece covers more of the wrist on the finger side than on the thumb side, the mitten-shaped piece forming the second side of the hand shield and being attached to the front surface of the sheet in a manner to form a pocket adapted to fit a hand, the pocket having an opening at the bottom of the mitten-shaped piece, the opening being near yet spaced away from the bottom edge and being sized for the insertion of a hand, the sheet and the piece being formed of a material individually selected from the group consisting of absorbent cellulosic material and plastic, the piece being shorter than the sheet and being attached to the sheet in a manner that allows the sheet to extend beyond the opening.

7. The hand shield of claim 6, wherein the opening at the end of the opening closest to the bottom edge of the rectangular sheet is at least about a 10° angle and at most about a 40° angle relative to the bottom edge of the rectangular sheet.

8. An array of pocketed sanitary hand shields each for receiving a hand and for protecting the hand from germs, comprising:

a continuous sheet of a flexible material having evenly-spaced weakened connections dividing the sheet into rectangular sections each having a top edge, a bottom edge, and two side edges; and a trapezoidal piece of a flexible material attached to the front surface of each rectangular section, each piece having a top edge, a bottom edge, and two parallel side edges which are perpendicular to the top edge and not perpendicular to the bottom edge, the trapezoidal piece being shorter than the rectangular section, the trapezoidal piece being sized to fit over a hand and being attached to its corresponding rectangular section in a manner such that the top edges and the side edges of each rectangular section and each trapezoidal sheet are aligned and each trapezoidal sheet is attached to its corresponding rectangular section along the top edge and the side edges of the trapezoidal piece and the rectangular section to form a pocket adapted to fit a hand and leaves an opening having two ends, each piece being shorter than each rectangular section and positioned so that the opening is spaced away from the bottom edge of the rectangular section and is present for the insertion of the hand, the opening being angled from one end to the other end relative to the bottom edge of the rectangular section.

9. The array of hand shields according to claim 8, wherein the continuous sheet and the pieces are formed of a material individually selected from the group consisting of absorbent cellulosic material and plastic.

10. The array of hand shields according to claim 8, wherein the trapezoidal pieces are also attached to the sections in a way which renders the pockets in the shape of mittens, each pocket having one section for the fingers of the hand and another section for the thumb of the hand.

11. The array of hand shields according to claim 8, further comprising a component selected from the group consisting of fragrances, antibacterial compounds, disinfectants and combination thereof included in a part of the array of hand shields, the part selected from the group consisting of the continuous sheet, the pieces, and a combination thereof.

12. The array of hand shields of claim 8, wherein the opening at the end of the opening closest to the bottom edge of each rectangular sheet is at least about a 10° angle and at most about a 40° angle relative to the bottom edge of each rectangular sheet.

* * * * *